US006836923B2

(12) United States Patent
Treacy et al.

(10) Patent No.: US 6,836,923 B2
(45) Date of Patent: Jan. 4, 2005

(54) DUST MOP ADAPTER

(75) Inventors: Terrence P. Treacy, Mansfield, TX (US); David J. Greubel, Arlington, TX (US)

(73) Assignee: Harper Corporation, Fairfield, IA (US)

( * ) Notice: Subject to any disclaimer, the term of this patent is extended or adjusted under 35 U.S.C. 154(b) by 116 days.

(21) Appl. No.: 10/252,968

(22) Filed: Sep. 23, 2002

(65) Prior Publication Data

US 2004/0055102 A1 Mar. 25, 2004

(51) Int. Cl.[7] ..... A47L 13/20; A47L 13/24

(52) U.S. Cl. ..... 15/229.8; 15/147.2; 15/229.7; 15/229.4; 15/228

(58) Field of Search ..... 15/147.2, 228, 15/229.4, 229.6, 229.7, 229.8; D32/50

(56) References Cited

U.S. PATENT DOCUMENTS 2,655,680 A * 10/1953 Geerin ..... 15/228
3,528,120 A * 9/1970 Lindstrom ..... 15/228
3,991,432 A * 11/1976 Griffin et al. ..... 15/229.8
3,996,639 A * 12/1976 Griffin et al. ..... 15/229.6
4,382,310 A * 5/1983 Moss ..... 15/229.8

FOREIGN PATENT DOCUMENTS

JP 2001-299659 * 4/2000

OTHER PUBLICATIONS

English translation of Detailed Description of JP 2001–299659 (above).*

* cited by examiner

*Primary Examiner*—Robert J. Warden, Sr.
*Assistant Examiner*—Laura C Cole
(74) *Attorney, Agent, or Firm*—John E. Toupal; Harold G. Jarcho

(57) ABSTRACT

An adapter for use with a dust mop having an annular frame pivotally coupled to a handle and including a cover for removable attachment to the frame and defining a lower surface covering a bottom surface of the frame and an upper surface defining first and second receiver portions for receiving first and second end portions of the frame.

19 Claims, 3 Drawing Sheets

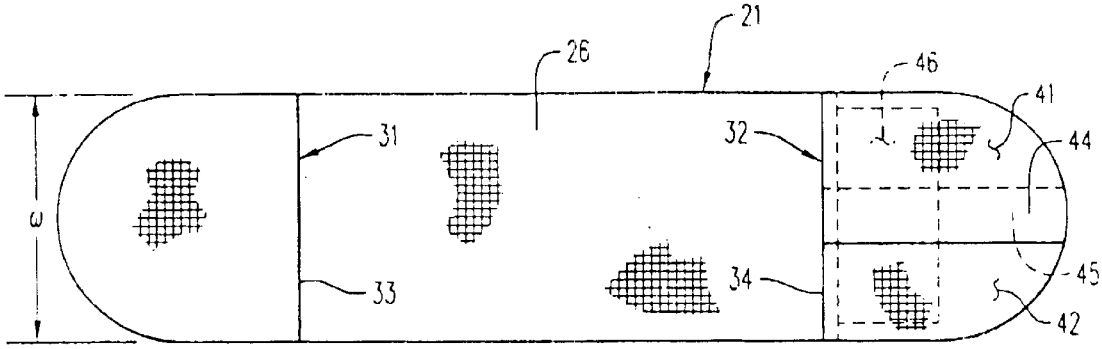
FIG. 3
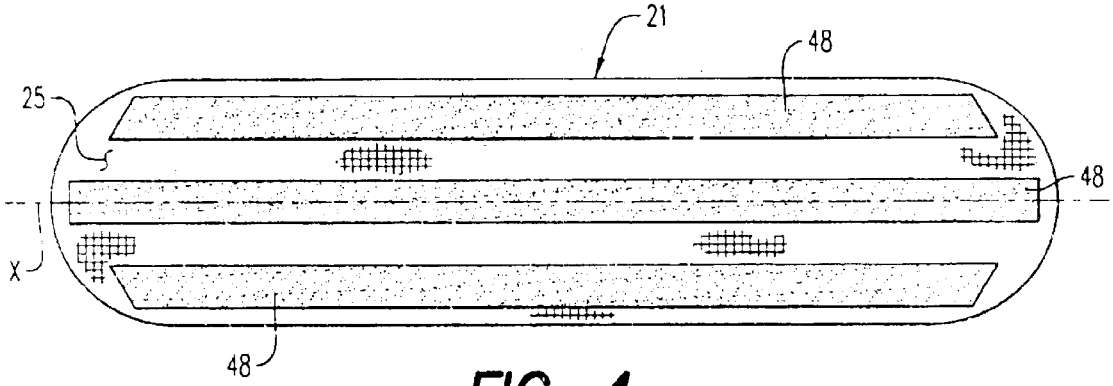
FIG. 4
FIG. 5
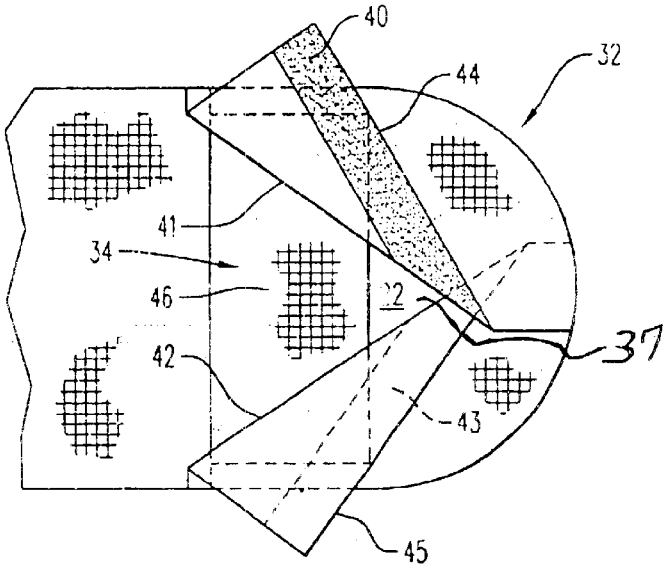

DUST MOP ADAPTER

BACKGROUND OF THE INVENTION

This invention relates generally to dust mops, and, more particularly, to an adapter for improving existing dust mops.

Extensively used dust mops utilize a cotton fabric head that is lashed by various means to a wire frame attached to an elongated handle. The cotton fiber heads do an adequate job of picking up dust and dirt on a floor and performance is enhanced by spraying the head with chemicals to increase its dust pickup capability. Although typical wire frames are not precisely manufactured components, the cotton loops on the duster heads act as cushions compensating for any non-planar condition of the frame. In addition, if a floor surface is not planar, the cushioning effect of the cotton loops allow the mop head to maintain ample contact with the floor.

Dusting performance is enhanced with a new cleaning cloth technology which employs synthetic fibers called microfibers. However, because of the reduced cushioning effect of the microfiber head it requires a differently designed mop head that is flat.

The object of this invention, therefore, is to provide an improved dust mop.

SUMMARY OF THE INVENTION

The invention is an adapter for use with a dust mop having an annular frame pivotally coupled to a handle and including a cover for removable attachment to the frame and defining a lower surface covering a bottom surface of the frame and an upper surface defining first and second receiver portions for receiving, respectively, first and second end portions of the frame. The adapter converts existing mop handles for use with efficient dust pads.

According to one feature of the invention, the annular frame is elongated with opposite first and second end portions straddling the coupling and the adapter includes a flexible cover defining the lower surface and having an upper surface defining first and second receiver portions for removably receiving, respectively, the first and second end portions.

According to another feature of the invention, the flexible cover is an envelope having a first wall forming the lower surface and a second wall forming the upper surface, and the adapter further comprises a resilient insert retained within the envelope. The insert provides rigidity while allowing some deformation to fully engage a floor surface.

According to another feature, the adapter has an upward curvature about a longitudinal axis. The adapter flattens against a floor surface in response to the application of force by the handle. The radius of curvature enhances the effectiveness of the insert.

According to yet other features of the invention, the first and second receiver portions are defined by inwardly opening pockets formed at opposite ends of the upper surface, one end of the envelope defines an opening for receiving the insert, and the second wall has flap portions covering the opening and having edges separable to allow passage of the insert and detachably engagable to form one of the pockets. These features simplify assembly of the mop.

According to further features, the cover is fabric, the insert is plastic, and the connector consists of Velcro strips secured to the lower surface and extending longitudinally thereon. The effectiveness of the mop is enhanced by these features.

The invention also encompasses a dust mop including an elongated handle; an annular frame defining a bottom surface; a coupling securing one end of the handle to the frame; an adapter shaped and arranged for detachable connection to the frame and defining a lower surface for covering the bottom surface; and a connector secured to the lower surface and adapted to detachably receive a dust pad.

DESCRIPTION OF THE DRAWINGS

These and other objects and features of the invention will become more apparent upon a perusal of the following description taken in conjunction with the accompanying drawings wherein:

FIG. 3 is a top view of a cover component shown in FIG. 1;

FIG. 4 is a bottom view of the adapter shown in FIG. 2;

FIG. 5 is a detailed drawing of one end of the cover shown in FIGS. 3 and 4;

DESCRIPTION OF THE PREFERRED EMBODIMENT

Figure 1:
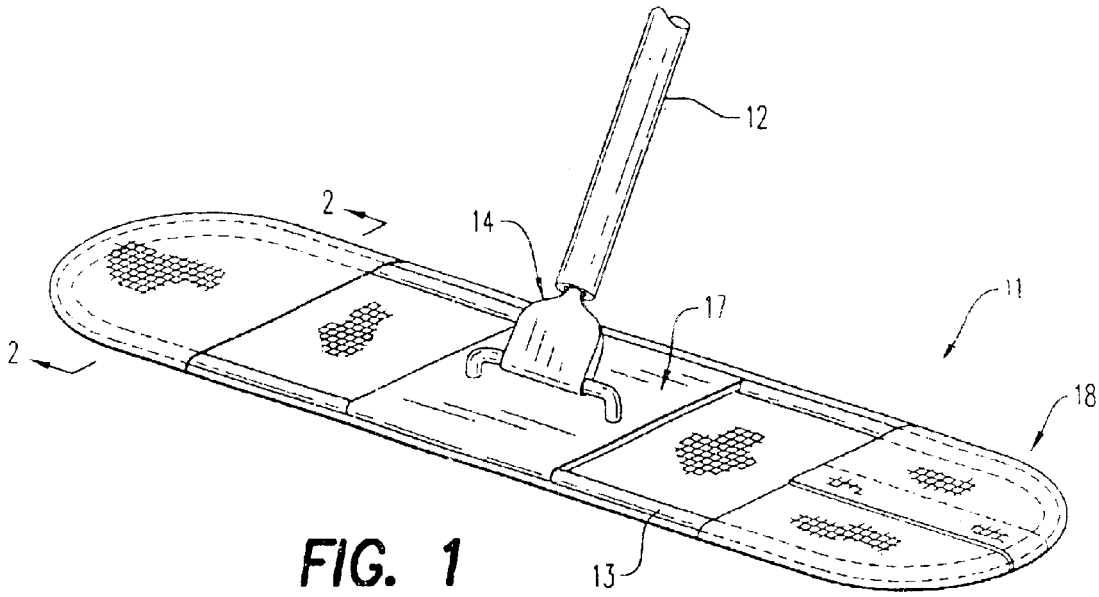
FIG. 1 is a perspective view of a dust mop 11 according to the invention.

A dust mop 11 includes an elongated handle 12 detachably connected to an elongated, annular wire frame 13 by a pivotable coupling 14. The wire frame 13 is shaped so as to have a substantially planar bottom edge surface 16. Provided at a mid-portion of the frame 13 is a bracket assembly 17 attached to the pivot coupling 14. The frame 13 supports a detachable adapter 18.

As illustrated in FIGS. 3–5, the adapter 18 is an elongated fabric cover 21 formed by first and second walls 22, 23 defining an envelope with a lower surface 25 and an upper surface 26. The overall shape of the envelope cover 21 conforms substantially to the annular frame 13. At opposite ends of the cover 21 are first and second receiver portions 31, 32 formed on the upper surface 26 by, respectively, inwardly opening pockets 33, 34. Also formed at one end of the envelope cover 21 is an opening 37 covered by the second pocket 34. The pocket 34 is defined by first and second flap portions 41, 42 of the cover 21 extending from perimeter portions of the upper surface 26. An inner marginal edge portion 44 of the flap 42 and an outer marginal edge portion 45 of the flap 41 are secured by VELCRO® hook and loop fastener strips 40 and 43. Another flap 46 extends outwardly from the opening 37 and is covered by the first and second flap portions 41, 42. Attached to the lower surface 25 of the cover 21 are a plurality of longitudinally extending Velcro connector strips 48 depicted in FIG. 4.

Figure 6:
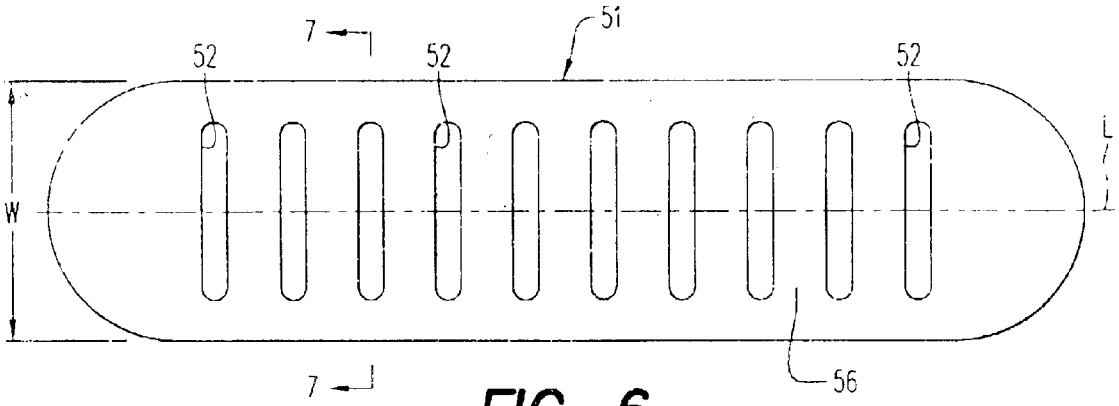
FIG. 6 is an insert element retained by the cover shown in FIGS. 3–5.
Figure 7:
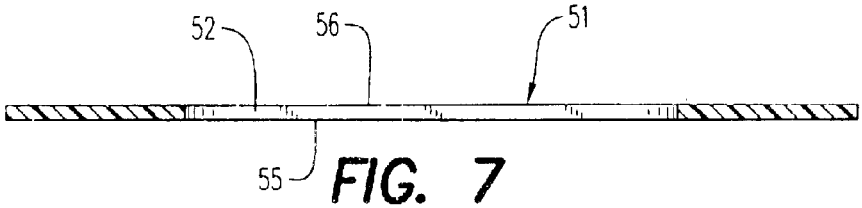
FIG. 7 is a cross-sectional view taken along lines 7—7 of FIG. 6.

The adapter 18 also includes a resilient plastic insert 51 retained (FIGS. 6, 7) within the envelope cover 21. As shown in FIGS. 6 and 7, the insert 51 is planar and has a one surface 56 facing downwardly and another surface 56 facing upwardly. Distributed along a longitudinal axis L of the insert 51 are a plurality of slots 52 extending transversely thereto. The slots 52 enhance the flexibility of the insert 51 about the longitudinal axis L. Also, the insert 51 has a width W (FIG. 6) slightly greater than the interior width (w) (FIG. 3) of the envelope 21.

Figure 2:
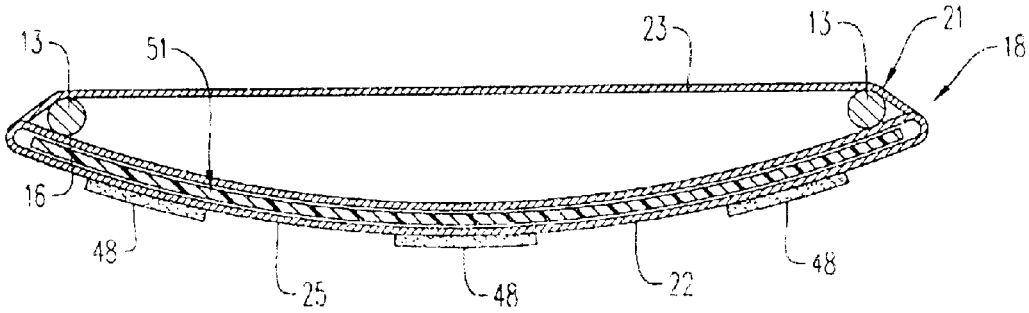
FIG. 2 is a cross-sectional view taken along lines 2—2 of FIG. 1.

To assemble the adapter 18, the first and second flaps 41, 42 are separated along their edges 44, 45 to expose the opening 37 of the envelope 21 as illustrated in FIG. 5. The opening 37 then accommodates entry of the insert 51 into the cover 21 with its one lower surface 55 facing the first wall 22 of the envelope cover 21 and its another surface 56 facing the second wall 23 thereof. Because of its greater width, the insert 51 causes the adapter 18 to bow as shown in FIG. 2 thereby producing an upward curvature of the lower surface 25 about a longitudinal axis X (FIG. 4) of the envelope cover 21. After insertion of the insert 51 into the envelope cover 21, the edges 44, 45 of the flaps 41, 42 are closed to again form the pocket 34. First and second ends of the wire frame 13 then are inserted into, respectively, the pockets 33, 34 on the envelope cover 21.

Figure 8:
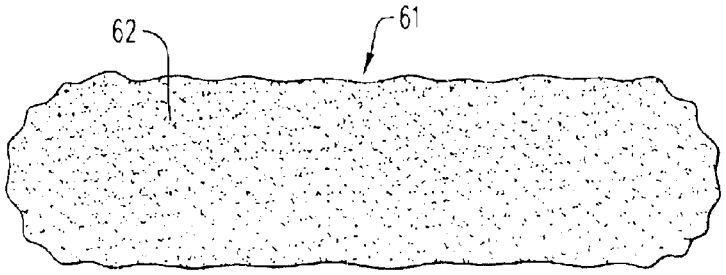
FIG. 8 is a bottom view of a dust pad for use with the dust mop shown in FIG. 1.
Figure 9:
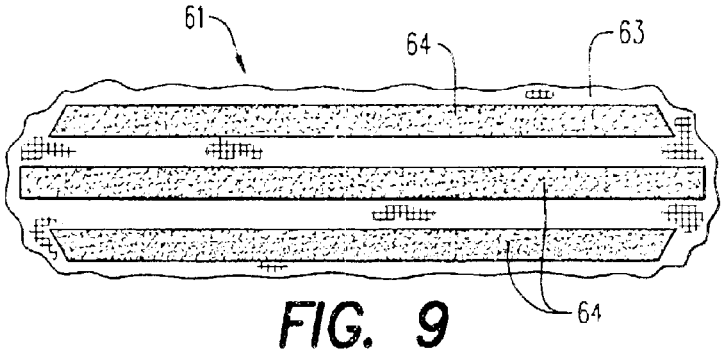
FIG. 9 is a top view of the dust pad shown in FIG. 8.

Prior to use, the dust mop 11 is provided with a dust pad 61 shown in FIGS. 8, 9. A bottom surface 62 of the dust pad 61 is formed by suitable dust accumulating fibers 62 while an upper surface 63 thereof retains a plurality of longitudinally extending Velcro strips 64 that are attached to the connector strips 48 on the lower surface 25 of the cover envelope 21. During a dusting operation, force applied downwardly to the handle 12 induces a flattening of the adapter 18 (FIG. 1) so as to bring the bottom surface 62 of the dust pad 61 into substantially planar contact with a floor surface being dusted. This flattening of the adapter 18 is facilitated by the flexibility of the envelope cover 21 and the resiliency of the plastic insert 51.

It should be understood that the afore-described is merely the preferred one of many possible embodiments of the invention, and that the scope of the invention should therefore only be limited according to the following claims.

What is claimed is:

1. A dust mop comprising:

an elongated handle;

an elongated frame defining a bottom surface and having opposite first and second end portions;

a coupling straddled by said first and second end portions and securing one end of said handle to said frame;

an adapter means shaped and arranged for detachable connection to said frame and comprising a flexible envelope defining a lower surface for covering said bottom surface and an upper surface defining first and second receiver portions for removably receiving, respectively, said first and second end portions; and a resilient insert retained within said envelope; and connector means secured to said lower surface and adapted to detachably receive a dust pad.

2. A dust mop according to claim 1 wherein said adapter has an upward curvature about its longitudinal axis and is adapted to flatten against a floor in response to an application of force by said handle, and said insert defines a plurality of slots extending transversely to said axis.

3. A dust mop according to claim 2 wherein said insert has a width greater than an interior width of said envelope so as to provide said upward curvature of said adapter.

4. A dust mop according to claim 3 wherein said first and second receiver portions are defined by inwardly opening pockets formed at opposite ends of said upper surface.

5. A dust mop according to claim 4 wherein one end of said envelope defines an opening for receiving said insert.

6. A dust mop according to claim 5 wherein said second wall comprises flap portions covering said opening and having edges separable to allow passage of said insert and detachably engagable to form one of said pockets.

7. A dust mop according to claim 6 wherein said cover is fabric.

8. A dust mop according to claim 7 wherein said insert is plastic.

9. A dust mop according to claim 8 wherein said connector means comprises hook and loop fastener strips secured to said lower surface and extending longitudinally thereon.

10. An adapter for use with a dust mop having a frame with an elongated axis and pivotally coupled to a handle and comprising:

an envelope for removable attachment to the frame and defining a lower surface covering a bottom surface of the frame and an upper surface defining first and second receiver portions for receiving, respectively, first and second end portions of the frame;

a resilient insert retained within said envelope; and connector means secured to said lower surface and adapted to detachably receive a dust pad.

11. An adapter according to claim 10 wherein said adapter has an upward curvature about its longitudinal axis and is adapted to flatten against a floor in response to an application of force by the handle.

12. An adapter according to claim 11 wherein said insert has a width greater than an interior width of said envelope so as to provide said upward curvature of said adapter.

13. An adapter according to claim 12 wherein said insert defines a plurality of slots extending transversely to said elongated axis.

14. An adapter according to claim 13 wherein said first and second receiver portions are defined by inwardly opening pockets formed at opposite ends of said upper surface.

15. An adapter according to claim 14 wherein said one end of said envelope defines an opening for receiving said insert.

16. An adapter according to claim 15 wherein said second wall comprises flap portions covering said opening and having edges separable to allow passage of said insert and detachably engagable to form one of said pockets.

17. An adapter according to claim 16 wherein said cover means is fabric.

18. An adapter according to claim 17 wherein said insert is plastic.

19. An adapter according to claim 18 wherein said connector means comprises VELCRO® hook and fastener strips secured to said lower surface and extending longitudinally thereon.

* * * * *